US005731021A

United States Patent [19]

Spector

[11] Patent Number: 5,731,021

[45] Date of Patent: Mar. 24, 1998

[54] COLLAPSIBLE CANTEEN FOR PRODUCING A BEVERAGE

[76] Inventor: Donald Spector, 380 Mountain Rd., Union City, N.J. 07080

[21] Appl. No.: 630,522

[22] Filed: Apr. 10, 1996

Related U.S. Application Data

[63] Continuation-in-part of Ser. No. 543,614, Oct. 16, 1995, Pat. No. 5,609,899, which is a continuation-in-part of Ser. No. 498,375, Jul. 5, 1995.

[51] Int. Cl.[6] ..... B65D 85/00

[52] U.S. Cl. ..... 426/111; 426/112; 222/105; 222/107; 229/108.1; 229/117.01

[58] Field of Search ..... 222/92, 94, 105, 222/107, 153.05, 562; 229/108.1, 117.01, 117.05, 117.08, 123.1; 426/111, 112, 115

[56] References Cited

U.S. PATENT DOCUMENTS

| | | | |
|---|---|---|---|
| 3,143,249 | 8/1964 | Merrill et al. | 222/105 |
| 3,319,684 | 5/1967 | Calhoun | 229/117.07 |
| 3,542,566 | 11/1970 | Wakefield | 426/112 |
| 4,696,840 | 9/1987 | McCullough et al. | 222/105 |
| 4,850,506 | 7/1989 | Heaps, Jr. et al. | 222/105 |
| 5,384,138 | 1/1995 | Robbins, III et al. | 426/111 |
| 5,609,899 | 3/1997 | Spector | 222/107 |

*Primary Examiner*—Philippe Derakshani
*Attorney, Agent, or Firm*—Michael Ebert

[57] ABSTRACT

A collapsible canteen formed by a collapsible carton having nested therein a collapsible pouch whose open mouth is in alignment with a neck projecting from the carton. The collapsible canteen which has a charge of powder deposited in the pouch is adapted to produce, in situ, a beverage when a hot or cold liquid is poured through the neck of the canteen into the pouch to dissolve the powder the nature of which determines that of the beverage.

8 Claims, 2 Drawing Sheets

COLLAPSIBLE CANTEEN FOR PRODUCING A BEVERAGE

RELATED APPLICATION

This application is a continuation-in-part of my application Ser. No. 08/543,614 filed Oct. 16, 1995 (now U.S. Pat. No. 5,609,899) entitled "Collapsible Canteen For Soft Drink" which is a continuation-in-part of my application Ser. No. 08/498,375 filed Jul. 5, 1995, entitled "Squeeze Canteen For Soft Drink," the disclosures of which are incorporated herein by reference.

BACKGROUND OF INVENTION

1. Field of Invention

This invention relates generally to canteens for dispensing potable liquids, and more particularly to a collapsible canteen which when erected, produces in situ a soft drink or other hot or cold beverage in which powders or crystals are dissolved in a liquid, the canteen being formed by a collapsible carton within which is nested a collapsible pouch whose open mouth is in alignment with the neck of the carton.

2. Status of Prior Art

A canteen is a flask for carrying drinking water or other potable liquids. Canteens are now commonly used by hikers and other travelers to carry potable liquids such as drinking water and fruit juice. Usually a canteen takes the form of a metal or plastic flask having a removable screw-on cap. While a child can quench his thirst with pure cold water, most children particularly when attending an amusement or theme park such as Disney World, prefer a cold soft drink. The problem a parent often faces in a popular amusement park when accompanying a thirsty child, is that while there are usually cold water fountains available from which the child is free to drink, the cold soft drink the child would prefer is not readily available. Indeed, on a busy day in an amusement park, there are usually long lines extending from the kiosks which sell cold soft drinks. And not only must one wait a fairly long period to obtain a cold soda, but its price is generally quite high, far more so than the going price in a retail supermarket.

It is known to produce a cold soft drink suitable for children by dissolving flavor crystals in cold water, one popular brand of such crystals being the KOOL AID brand. These crystals combine a sweetener with a flavoring agent such as a cherry or orange flavor, to produce a low-cost soft drink acceptable for children. While at home where a glass and a stirring spoon are available to produce a cold soft drink from flavor crystals, it is not feasible to carry this equipment to an amusement park or other outdoor site to provide children with soft drinks.

My above-identified copending application Ser. No. 08/496,375 provides a squeeze canteen for producing, in situ, a cold soft drink, and then dispensing the drink, thereby making available to a child in an amusement or theme park or other outdoor site provided with a cold water supply such as a fountain, an inexpensive yet satisfying drink.

This canteen includes a collapsible pouch molded to simulate a known character and provided with a female socket forming the mouth of the pouch. Inserted in the socket is a removable male nozzle plug incorporating a normally-closed valve. Deposited in the pouch is a charge of water-soluble flavor crystals. When cold water is poured into the pouch through its mouth, the crystals are then dissolved to produce a soda drink that is then sealed in the pouch by the plug inserted in the socket. To drink from the canteen, the valve is first opened and the pouch is then squeezed to pressurize the soda drink and discharge it from the nozzle plug.

My above-identified copending application Ser. No. 08/543,614 discloses a collapsible carton having deposited therein a charge of water-soluble flavor crystals such that when the canteen is erected and water is poured therein, the crystals are then dissolved to produce, in situ, a soft drink.

The carton includes square top and bottom walls, and a neck projecting from the top wall to receive a removable cap. Also included is a first pair of opposing side walls that are inwardly foldable in half whereby when the canteen is collapsed, the folded in first side walls are then sandwiched between the top and bottom wall. Further included is a second pair of opposing side walls that are outwardly foldable in half and are each provided with a triangular gusset joined to a side wall in the first pair, whereby when the canteen is collapsed, the gussets are then folded into the folded out second pair of side walls to define a pair of outstretched wings. These wings are then folded under the bottom wall to create a square-shaped pack.

When this collapsible carton is formed of the same wax-coated cardboard currently used to store milk or fruit juices, the carton is only useable to contain a cold liquid, for the wax coating which serves to render it liquid impermeable, cannot withstand the heat of a hot liquid. One therefore cannot use this carton to produce in situ a hot chocolate or coffee, for the hot beverage would interact with the wax coating.

Moreover, the collapsible carton must be water proof, and in a cartoon of the type disclosed in my copending application which is scored to define foldable side walls and gussets, these score lines which weaken the cardboard also may impair its liquid-impermeable properties.

SUMMARY OF INVENTION

The main object of the invention is to provide a collapsible canteen adapted to produce in situ a cold or hot beverage.

More particularly, an object of the invention is to provide a canteen of the above type in which a collapsible pouch is nested within a collapsible carton, the collapsible carton having foldable sides and gussets which make it possible to collapse the carton and the pouch therein without difficulty.

A significant feature of the invention is that a pair of inwardly-foldable side walls of the carton are provided at their fold lines with finger holes, to facilitate pulling out of these side walls when erecting the carton.

Also an object of the invention is to provide a canteen of the above type which can be mass-produced at relatively low cost.

Briefly stated, these objects are attained in a collapsible canteen formed by a collapsible carton having nested therein a collapsible pouch whose open mouth is in alignment with a neck projecting from the carton. The collapsible canteen which has a charge of concentrate powder deposited in the pouch is adapted to produce, in situ, a beverage when a hot or cold liquid is poured through the neck of the canteen into the pouch to dissolve the powder the nature of which determines that of the beverage.

The carton is provided with square top and bottom walls and a neck projecting from the top wall to receive a removable cap, the open mouth of the pouch being sealed to the underside of top wall in alignment with the neck. Also included is a first pair of opposing side walls that are inwardly foldable in half whereby when the carton is collapsed, the folded-in side walls are then sandwiched between the top and bottom walls. Further included is a second pair of opposing side walls that are outwardly folded in half, each side wall being provided with a triangular gusset joined to a corresponding side wall of the first pair whereby when the carton is collapsed, the gussets are then folded into the folded out second pair of side walls to define a pair of outstretched wings which are then folded under the bottom wall to create a square-shaped pack within which is the collapsed pouch in a flattened state.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
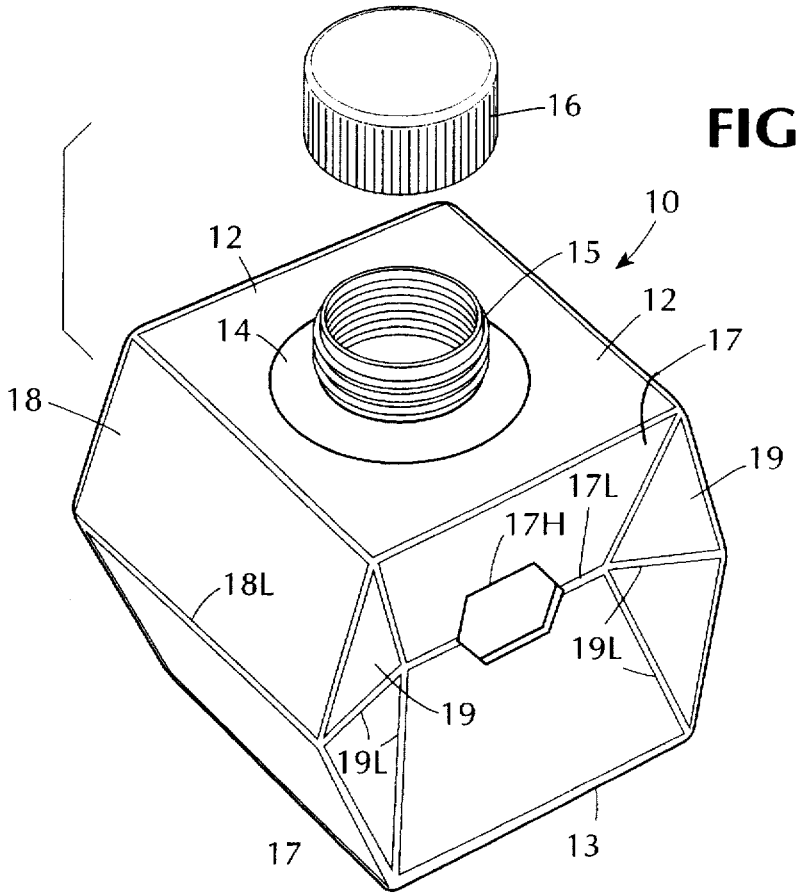
FIG. 1 is a perspective view of a collapsible canteen in accordance with the invention, as seen with its cap removed.
Figure 2:
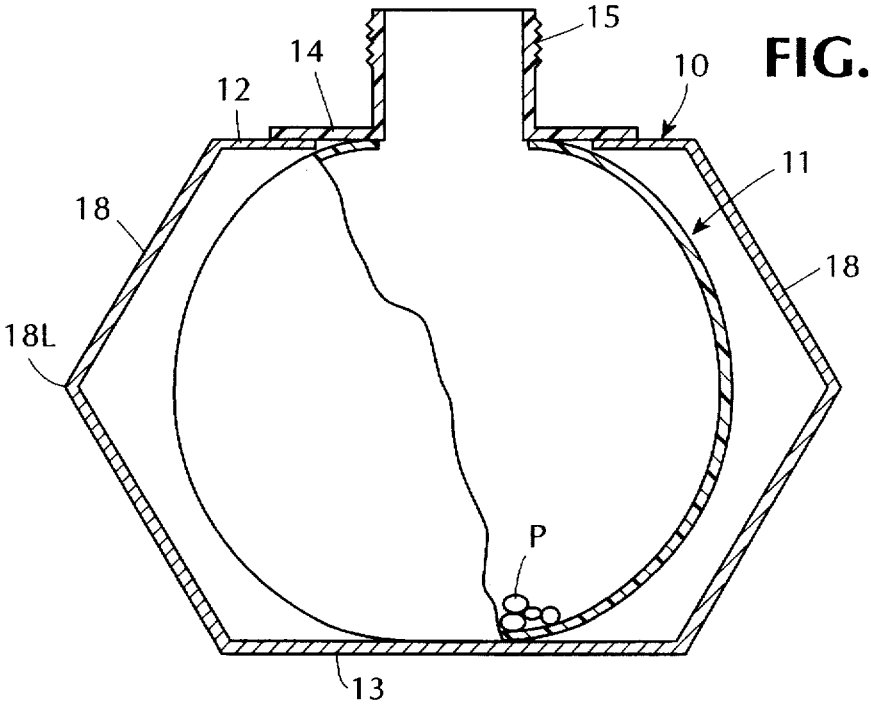
FIG. 2 is a section taken through the canteen showing the collapsible carton in its erected state and a collapsible pouch nested within the carton.

Referring now to FIGS. 1 and 2, there is shown a collapsible canteen in accordance with the invention as it appears in an erected state, the main components of the canteen being a carton 10 and a pouch 11 nested therein.

Carton 10 is preferably fabricated of the same cardboard material used in conventional milk and fruit juice cartons. Pouch 11 is formed of synthetic plastic film material, such as polyethylene, having high-temperature characteristics so that the pouch is unaffected by hot liquids which are unacceptable to the cardboard forming the carton.

Deposited in pouch 11 is a charge of concentrate powder which may be flavor crystals which when dissolved in cold water produces, in situ, a soft drink such as an orange or grape drink. Or the concentrate powder may be an instant coffee or tea, or chocolate powder which when dissolved in hot or boiling water then yields a hot beverage.

Carton 10 includes square top and bottom walls 12 and 13. Mounted at the center of the cardboard top wall 12 is a circular plastic washer 14 on which is anchored an upwardly-projecting neck 15. Neck 15 is externally threaded to receive a removable screw-on cap 16. In practice, a detachable plastic film or foil seal may be attached to the lip of neck 15, the seal being of the type used to seal orange juice cartons.

The open mouth of pouch 11 whose dimensions in the uncollapsed state are such that the pouch almost fully occupies the carton 10 in its fully erected state, is sealed to the underside of washer 14 so that liquid fed into the pouch does not spill into the carton.

Extending between and bridging the top and bottom walls 12 and 13 of carton 10 is a first pair of opposing side walls 17 having a fold line 17L whereby each of these walls is foldable inwardly in half. Die-cut into each fold line 17L is a hexagonal finger hole 17H. Also extending between and bridging the top and bottom walls is a second pair of opposing side walls 18 having a fold line 18L whereby each of these walls may be outwardly folded in half.

The pair of second side walls 18 are each provided with a triangular gusset 19 that is integral with the corresponding first side wall 17. Each gusset 19 has a fold line 19L which is aligned with fold lines 17L and 18L so that the side walls and the gussets fold simultaneously.

Figure 3:
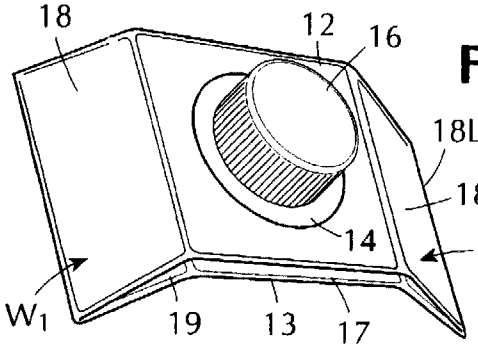
FIG. 3 shows the canteen in its collapsed state.

To collapse the carton, side wall 17 is folded in so that as shown in FIG. 3, the folded-in side walls 17 are then sandwiched between the top and bottom walls 12 and 13. And gussets 19 are folded into the folded-out side walls 18 to define a pair of outstretched wings $W_1$ and $W_2$. FIG. 3 therefore shows the collapsed state of the canteen.

Figure 4:
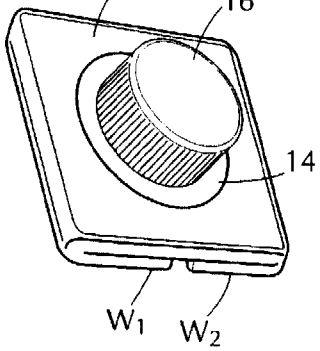
FIG. 4 shows the canteen in its pack state.

In order to render the canteen still more compact, the wings $W_1$ and $W_2$ are folded in under the bottom wall 13 of the carton, as shown in FIG. 4, to create a square pack occupying very little space. This pack may be packaged in a plastic envelope.

When carton 10 formed of relatively rigid cardboard is collapsed to assume the form shown in FIG. 3, the collapsible plastic pouch 11 nested within the carton is then flattened as is the powder charge deposited in the pouch. Hence the flattened pouch within the collapsed carton does not cause the carton to bulge to any appreciable degree.

Figure 6:
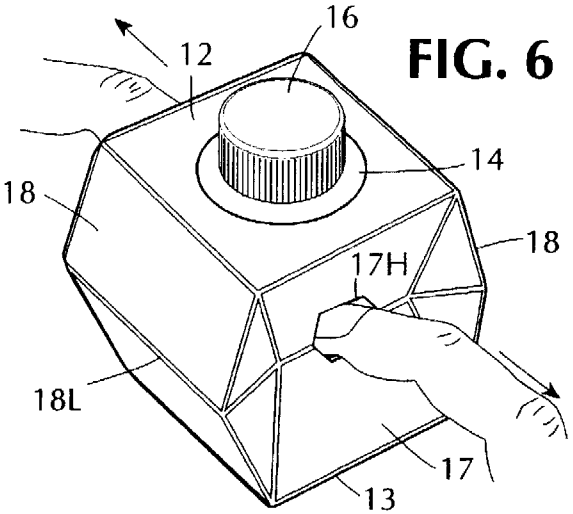
FIG. 6 illustrates how the side walls of the opened-up carton are pulled out so that the carton is then fully erected.
Figure 7:
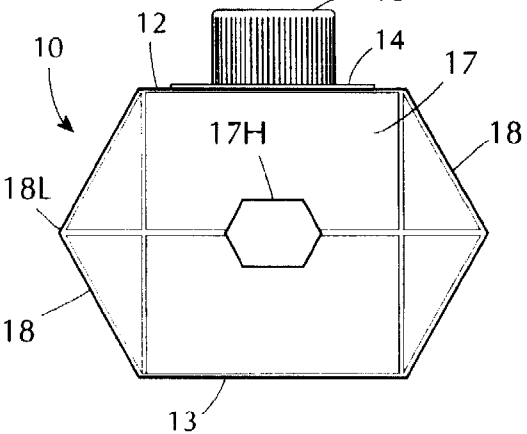
FIG. 7 is a side view of the fully-erected carton.
Figure 5:
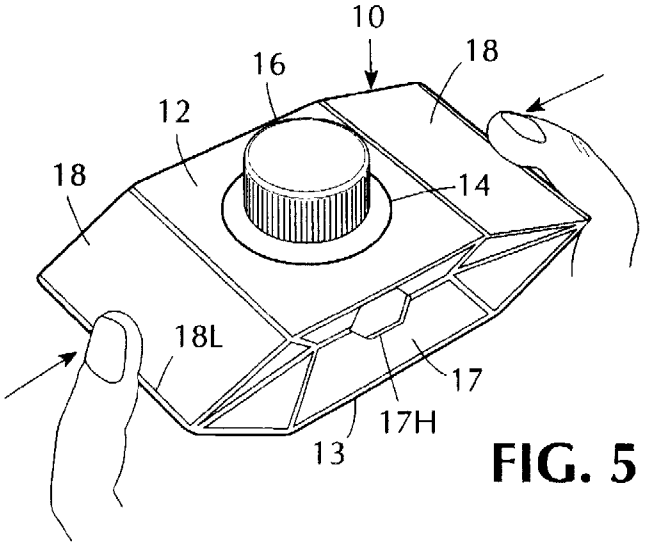
FIG. 5 illustrates how the carton is squeezed so that it opens up.

The manner in which the collapsed canteen is fully erected is illustrated in FIGS. 5, 6 and 7. First wings $W_1$ and $W_2$ of the carton in its pack state shown in FIG. 4 are unfolded as in FIG. 3, then the top wall 12 is raised above the bottom wall 13 to expand the carton. This causes it to assume the partially erect form shown in FIG. 5 with the first pair of side walls 17 partially folded in and the second pair of side walls partially folded out.

The user, as shown by the arrows in FIG. 5, then squeezes in side walls 18 on its fold-lines 18L to further raise the carton. And with fingers of his two hands inserted in finger holes 17H in side walls 17, the user pulls out these side walls, as shown by the arrows in FIG. 6. The carton and the pouch nested therein are then fully erect as shown in FIG. 7 and the canteen now in a condition to be put to use.

When one wishes to put the canteen to use and the canteen has in its pouch a charge P of flavor crystals to make a soda pop, cap 16 is removed and cold water is poured into the pouch 11 through the neck 15 in carton 10. Cap 16 is screwed back so that the canteen can be shaken to fully dissolve the flavor crystals in the water. Now the canteen contains a soft drink whose flavor depends on the nature of the crystals, which soda can be imbibed by a child or adult.

In a similar manner one can produce a hot beverage in situ within the canteen whose nature depends on the powder concentrate disposed in the pouch, in which case hot or boiling water is poured into the pouch. Or the powder can be a water-soluble pharmaceutical powder such as an anti-acid agent.

Instead of a powder concentrate one may deposit in the pouch a liquid concentrate which when hot or cold water is added thereto forms a drinkable beverage. Or the powder may be freeze dried food particles which when hot water is added thereto forms a soup.

Though the collapsible canteen is inexpensive to manufacture, and therefore disposable, it may be put to repeated use as a canteen. Thus once the canteen is put to use to produce a beverage and the beverage is consumed, the pouch may be washed out with water and the canteen again used this time just as a canteen to store water, juice or other liquid.

While there has been shown a preferred embodiment of a collapsible canteen in accordance with the invention, it will be appreciated that many changes may be made therein without departing from the spirit of the invention. Thus instead of fabricating the carton of cardboard, it may be made of synthetic plastic walls and gussets with living hinges to render the walls and gussets foldable, thereby providing a carton having a prolonged effective life.

I claim:

1. A collapsible canteen adapted to produce, in situ, a beverage when the canteen is in its erected state, said canteen comprising:

A. a collapsible carton having foldable side walls and a neck projecting from a top wall on which is received a removable cap;

B. a collapsible pouch within the carton formed of flexible film material having an open mouth joined to the underside of the top wall in alignment with the neck; and C. a charge of concentrate deposited in the pouch whereby when the canteen is in a collapsed state, the pouch and the charge therein within the carton are then flattened, and when the canteen is in an erected state and the cap is then removed, liquid may be poured into the pouch to dissolve the concentrate to produce a beverage whose nature depends on the nature of the concentrate, the side walls of the carton being formed by a first pair of opposed side walls extending between and bridging top and bottom walls and being inwardly foldable in half whereby when the carton is collapsed, the folded-in first pair of walls is then sandwiched between said top and bottom walls, and a second pair of opposed side walls extending between and bridging the top and bottom walls and being outwardly foldable in half, each of the second pair of side walls being provided with a triangular gusset joined to a corresponding side wall in the first pair of walls whereby when the carton is collapsed, the gussets are then folded into the folded out second pair of side walls to define a pair of outstretched wings.

2. A canteen as set forth in claim 1, in which the concentrate is a charge of powder formed by flavor crystals which when dissolved in a cold liquid forms a soda.

3. A canteen as set forth in claim 1, in which the liquid poured into the pouch is hot to produce a hot beverage.

4. A canteen as set forth in claim 1, in which the carton is formed of cardboard.

5. A canteen as set forth in claim 1, in which the outstretched wings are folded under the bottom wall to create a pack.

6. A canteen as set forth in claim 1, in which each inwardly foldable wall in the first pair of side walls has a finger hole at its fold line to facilitate erection of the canteen by pulling out the first pair of side walls.

7. A canteen as set forth in claim 1, in which the concentrate is a pharmaceutical powder.

8. A canteen as set forth in claim 1, in which the pouch is formed of synthetic plastic film material that is non-reactive with respect to the beverage contained in the pouch.

* * * * *